United States Patent [19]

Lamont

[11] Patent Number: 4,884,564

[45] Date of Patent: Dec. 5, 1989

[54] SNORKEL

[75] Inventor: Mark D. Lamont, Long Beach, Calif.

[73] Assignee: Undersea Industries, Inc., Rancho Dominguez, Calif.

[21] Appl. No.: 223,547

[22] Filed: Jul. 25, 1988

[51] Int. Cl.[4] ..... A62B 7/00

[52] U.S. Cl. ..... 128/201.11; 128/200.26

[58] Field of Search ..... 128/201.11, 200.26

[56] References Cited

U.S. PATENT DOCUMENTS

| | | | |
|---|---|---|---|
| 46,902 | 3/1865 | Hawkins . | |
| 183,521 | 10/1876 | Weck . | |
| 2,317,236 | 4/1943 | Wilen | 128/201.11 |
| 3,467,091 | 1/1968 | Aragona . | |
| 3,653,086 | 4/1972 | Gongwer . | |
| 3,768,504 | 10/1973 | Rentsch | 128/145 A |
| 3,860,042 | 1/1975 | Green . | |
| 3,993,060 | 11/1976 | Mitchell . | |
| 4,066,077 | 1/1978 | Shamlian . | |
| 4,071,024 | 1/1978 | Blanc | 128/145 A |
| 4,230,106 | 10/1980 | Geeslin et al. . | |
| 4,380,232 | 4/1983 | Doyle . | |
| 4,562,836 | 1/1986 | Perron . | |
| 4,583,536 | 4/1986 | Jan . | |
| 4,610,246 | 9/1986 | Delphia . | |
| 4,655,212 | 4/1987 | Delphia . | |
| 4,708,135 | 11/1987 | Arkema . | |

FOREIGN PATENT DOCUMENTS

| | | | |
|---|---|---|---|
| 2844357 | 12/1981 | France | 128/201.11 |
| 590401 | 4/1959 | Italy | 128/201.11 |
| 312092 | 6/1969 | Sweden | 128/201.11 |
| 2039748 | 8/1980 | United Kingdom | 128/201.11 |

*Primary Examiner*—Edgar S. Burr
*Assistant Examiner*—Huong Q. Pham
*Attorney, Agent, or Firm*—Leonard Tachner

[57] ABSTRACT

An improved diving snorkel for increasing the effectiveness of water purging and for decreasing the likelihood of water interference with breathing, and for reducing the breathing resistance, utilizes one or more of the following features: A trough in the partition between the breathing tube and the purge conduit using a hole to drain water and prevent backflow even when the diver rotates his head; a rise or deflector on the mouthpiece side of the partition to resist water flow toward the mouthpiece and promote drainage through a hole in the partition; a Venturi-type construction in the breathing tube to increase water purgin efficiency for a given exhalation effort; as well as decrease the resistance to air flow to the user; and an air trap immediately exterior to the purge valve in the branch conduit for reducing the resistance to opening of the valve thus promoting easier drainage of residual water in the branch conduit.

7 Claims, 5 Drawing Sheets

SNORKEL

BACKGROUND OF THE INVENTION

1. Field of the Invention

This invention relates generally to a snorkel such as used by spear fishermen. More particularly, this invention relates to a mechanism for more efficient purging of the water column and more efficient water drainage to enhance snorkel breathing.

2. Prior Art

The experienced free diver, using a snorkel, maintains his face down underwater even as he returns to the surface following a short dive. Such excursions or other maneuvers fill his snorkel tube with water that must be purged in order to resume snorkel breathing. Water is normally purged by producing a short, abrupt blast of air. The water moves essentially as a near solid mass before the water has a chance to break apart and slip into the airstream. The solid mass of water, propelled by an exhalation by the user will purge the greater amount of water from the breathing tube and will require the least amount of effort. The exhalation effort required is considerable, but easily produced by a strong diver. However, not all persons who use snorkels are capable of generating the required exhalation effort. One solution to the aforementioned problem is that of providing purge valves which allow the column of water in the snorkel tube to drop to the level of the surrounding water which would otherwise be trapped. One particularly advantageous snorkel configuration which utilizes a large purge valve at the end of a branch or bypass conduit connected to the snorkel tube at a place spaced from the snorkel mouthpiece, is disclosed in U.S. Pat. No. 4,278,080 issued July 14, 1981 to the assignee of the present invention. While the snorkel disclosed in the aforementioned patent is a significant improvement over the prior art, additional improvements are desirable in order to further decrease the effort required to purge the snorkel of water and also in order to more effectively rid the snorkel and particularly the mouthpiece portion thereof of any remaining water which might otherwise interfere with the breathing effort.

In addition to the aforementioned U.S. Patent, the following patents are also relevant to the general art of snorkels:

U.S. Pat. No. 46,902 Hawkins
U.S. Pat. No. 3,467,091 Aragona
U.S. Pat. No. 3,653,086 Gongwer
U.S. Pat. No. 3,768,504 Rentsch, Jr.
U.S. Pat. No. 3,860,042 Green
U.S. Pat. No. 3,993,060 Mitchell
U.S. Pat. No. 4,066,077 Shamlian
U.S. Pat. No. 4,071,024 Blanc
U.S. Pat. No. 4,230,106 Geeshin, et al
U.S. Pat. No. 4,380,232 Doyle
U.S. Pat. No. 4,562,836 Penon
U.S. Pat. No. 4,583,536 Jan
U.S. Pat. No. 4,610,246 Delphia
U.S. Pat. No. 4,655,212 Delphia
U.S. Pat. No. 4,708,135 Arkema

SUMMARY OF THE INVENTION

The present invention comprises an improved snorkel having a number of additional novel features, each of which is designed to provide a means for reducing the effort required to purge the water from the snorkel to more effectively reduce the possible interference of any remaining water with the breathing effort or to result in easier breathing by providing a less turbulent path for airflow. In one particular embodiment which utilizes the branch conduit and purge valve concept of the aforementioned patent, the partition used to divide the branch or bypass conduit from the main snorkel conduit is provided with a trough having a hole at about the center thereof and positioned at the lowest part of the trough which separates the two conduits. Such a trough-shaped partition promotes water drainage into the branch conduit located away from the mouthpiece and in addition forms a wall or dam which prevents residual water in the branch conduit adjacent the purge valve from re-entering the main conduit or primary breathing tube even when the divers head is rotated in various directions. This feature therefore reduces the possibility of the diver choking on residual water that might otherwise inadvertently re-enter the breathing tube after the user has first expelled the water from the snorkel by means of an exhalation. This is particularly noticeable to the diver because he has just expelled a held breath of air and is in need of a fresh supply immediately thereafter.

A second feature of the present invention comprises a rise or deflector positioned within the breathing tube or main conduit adjacent an aperture in the partition between the main conduit and the branch conduit. This rise or deflector is designed to channel the water that adheres to the breathing tube upon exhalation, into the reservoir in the branch conduit adjacent the purge valve and helps prevent it from flowing back into the breathing chamber adjacent the mouthpiece.

Still another highly advantageous feature of the present invention comprises a thickened wall portion of the breathing tube which forms a Venturi-type constriction. Such a constriction accelerates airflow upon exhalation which promotes laminar flow of the water through the breathing tube without any significant restriction of air to the diver. Consequently, the water molecules are held together thereby increasing the likelihood that the plug of water being expelled by the diver upon exhalation through the breathing tube will remain substantially uncorrupted and reduce the effort required to expel the water and also reduce the amount of residual water remaining in the tube after exhalation.

Still another feature of the present invention comprises a hood forming a bubble trap or air trap that is provided exterior to the purge valve in the branch conduit on the ambient water side of the valve. This feature allows the valve to open easier as compared to a valve which opens against the higher viscosity of ambient water exterior to the snorkel. Thus, this feature of the invention provides the substantial benefit of allowing easier water drainage from the reservoir of water formed in the branch conduit within the snorkel adjacent the purge valve.

OBJECTS OF THE INVENTION

It is therefore a principal object of the present invention to provide an improved snorkel having one or more novel features which either increase the efficiency of water purging, decrease the likelihood of any water inadvertently reaching the mouthpiece or provide easier breathing for the diver.

It is an additional object of the present invention to provide an improved snorkel of the type having a main conduit and a bypass or branch conduit separated by a partition where the improvement comprises a trough-shaped recess in the partition and having an aperture at the lower most portion thereof designed to increase the drainage from the main tube into the branch tube and to reduce inadvertent flow of water from the branch tube into the main tube.

It is still an additional object to provide an improved snorkel, the mouthpiece portion of which is provided with a rise or deflector which tends to prevent water from flowing along the conduit surface toward the mouthpiece.

It is still an object of the present invention to provide an improved snorkel, the air tube of which is provided with a shaped wall portion forming a constriction having a Venturi effect on the air and water being expelled by the diver during exhalation for increasing the efficiency of purging water from the snorkel and increasing the flow of inhaled air to the diver.

It is still an additional object of the present invention to provide an improved snorkel of the type having a main conduit and a branch conduit separated by a partition, the branch conduit terminating in a purge valve, the improvement comprising an air trap formed on the exterior side of the purge valve to promote easier drainage of water through the purge valve.

BRIEF DESCRIPTION OF THE DRAWINGS

The aforementioned objects and advantages of the present invention as well as additional objects and advantages thereof will be more fully understood hereinafter as a result of a detailed description of preferred embodiments when taken in conjunction with the following drawings in which.

DETAILED DESCRIPTION OF PREFERRED EMBODIMENTS

Figure 1:
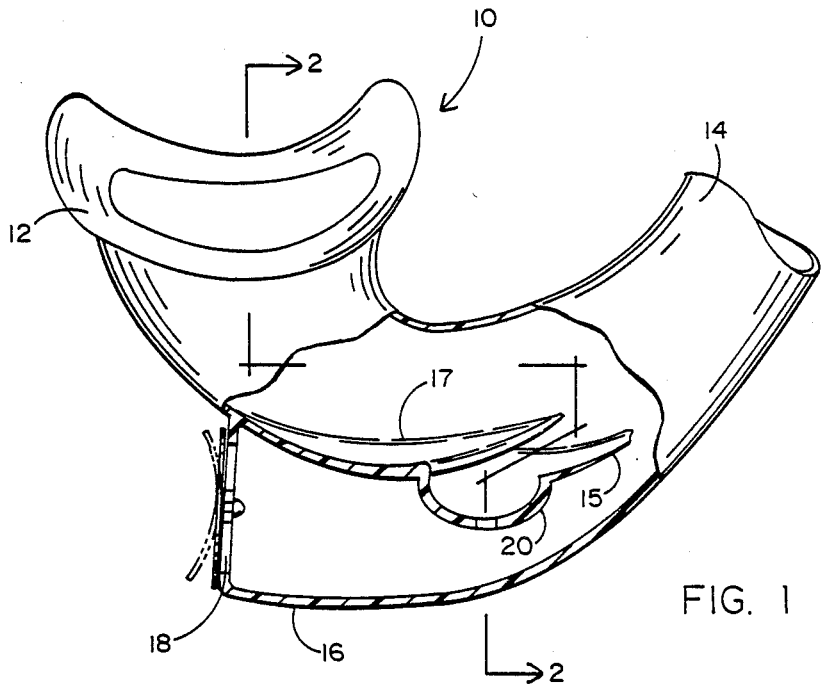
FIG. 1 is a partially cross-sectioned three dimensional view of a first embodiment of the present invention illustrating the partition trough and deflector features of the invention.

In the following description, functionally similar elements of the various embodiments are identified by the same reference numerals. Referring now to FIG. 1 it will seen that the improved snorkel 10, of the present invention comprises a mouthpiece 12, a breathing tube 14, and a branch conduit 16, the latter being segregated from the breathing tube by a partition 15, the branch conduit terminating in a check valve 18 in the manner generally disclosed in U.S. Pat. No. 4,278,080 to Schuck. One of the novel features of the present invention resides in the use of a depression or trough 20 in the partition 15. Trough 20 is provided with a hole or aperture 22 at the lower most portion thereof and which provides a passage from the main conduit of breathing tube 14 to the bypass or branch conduit 16 thereof. Trough 20 is shaped to promote the passage of any water remaining in the mouthpiece side of breathing tube 14 to the branch conduit side of partition 15 by promoting the collection of any such remaining water in a manner which makes it likely that any such water would pass through hole 22. An additional advantage of trough 20 is that the convex shape of the trough walls 24 reduces the likelihood of water passing back through hole 22 from the branch conduit 16 into the mouthpiece side of the breathing tube 14. This feature of the invention is shown in FIGS. 2 and 3.

Figure 2:
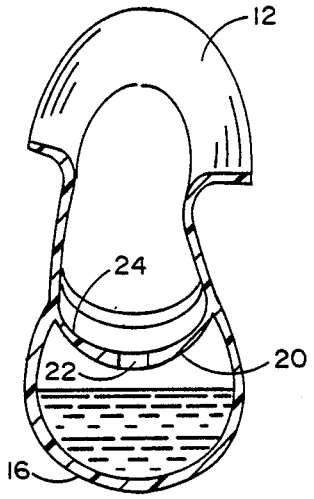
FIG. 2 is a cross-sectional view taken along lines 2—2 of FIG. 1.
Figure 3:
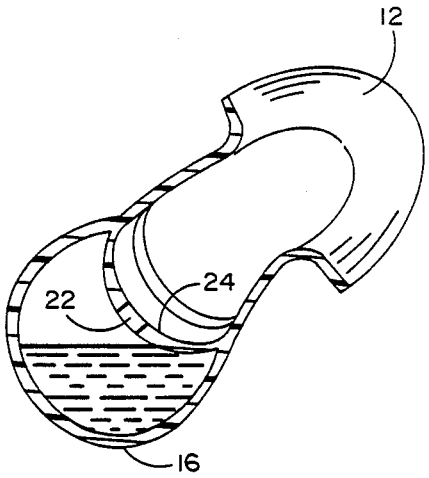
FIG. 3 is a view similar to that of FIG. 2 but illustrating the effect of the trough feature of the invention upon rotation of the diver's head under water.

As seen in FIG. 2, when the snorkel 10 is held in its normal upright position, the reservoir of water within branch conduit 16 is usually below the level of the trough 20 so that there is no likelihood of water passing back into the mouthpiece side of the breathing tube. However, as seen in FIG. 3, when the snorkel 10 is rotated as a result of a maneuver by the diver or simply by rotation of his head, such as for looking from side-to-side or up toward the surface, the reservoir of water within branch conduit 16 is more likely to pass back through hole 22, into the mouthpiece side of the breathing tube. However, the unique shape of the trough wall 24 tends to reduce the likelihood of such reverse passage of water and therefore improve the performance of the snorkel 10.

Figure 4:
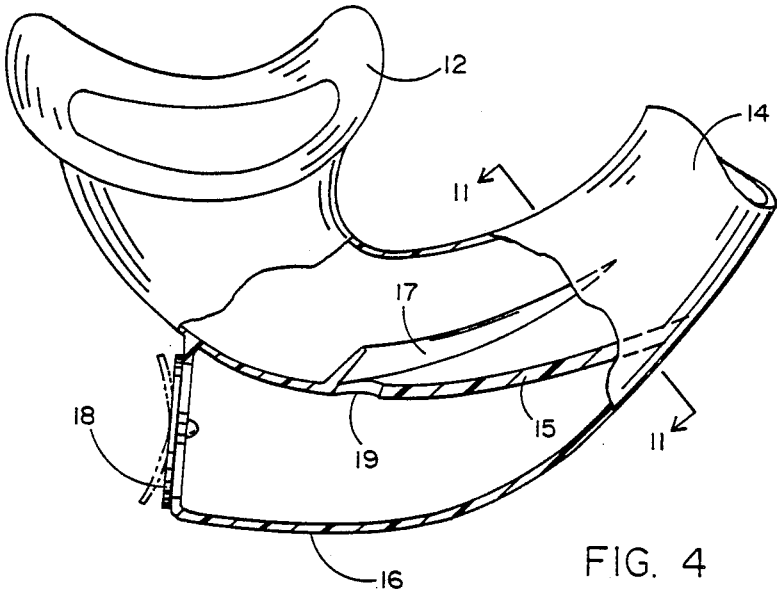
FIG. 4 is a view of a second embodiment of the invention similar to that of FIG. 1, but showing the use of a deflector or rise with a more conventional partition.
Figure 5:
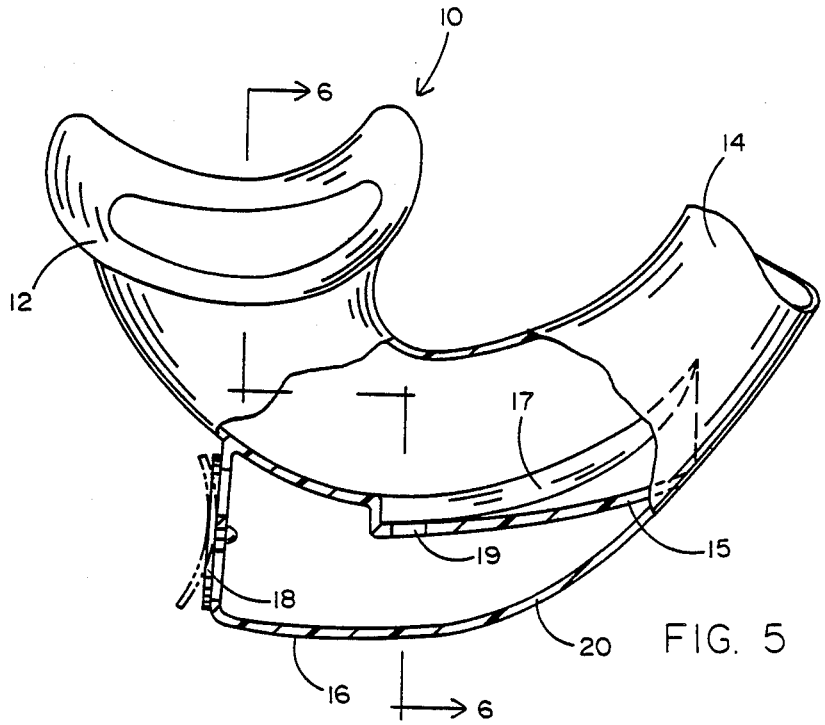
FIG. 5 is a partially cross-sectioned view of the embodiment of FIG. 4 but illustrating a modified deflector configuration.
Figure 6:
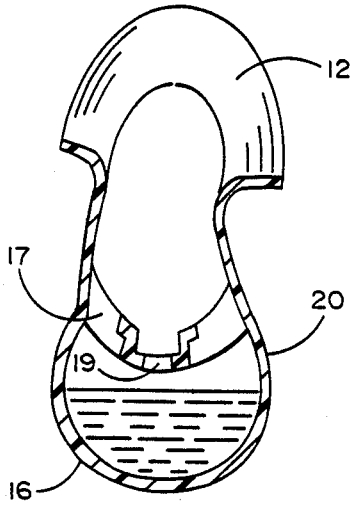
FIGS. 6 and 7 illustrate cross-sectional views taken along lines 6—6 of FIG. 5.
Figure 7:
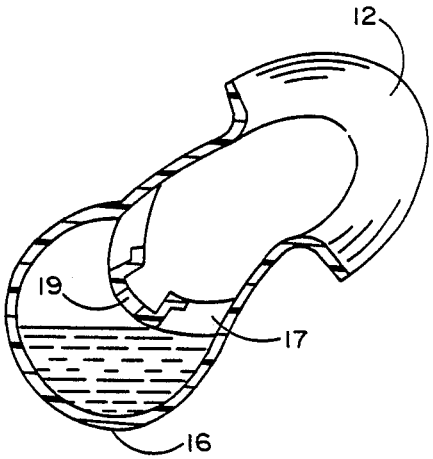
Figure 8:
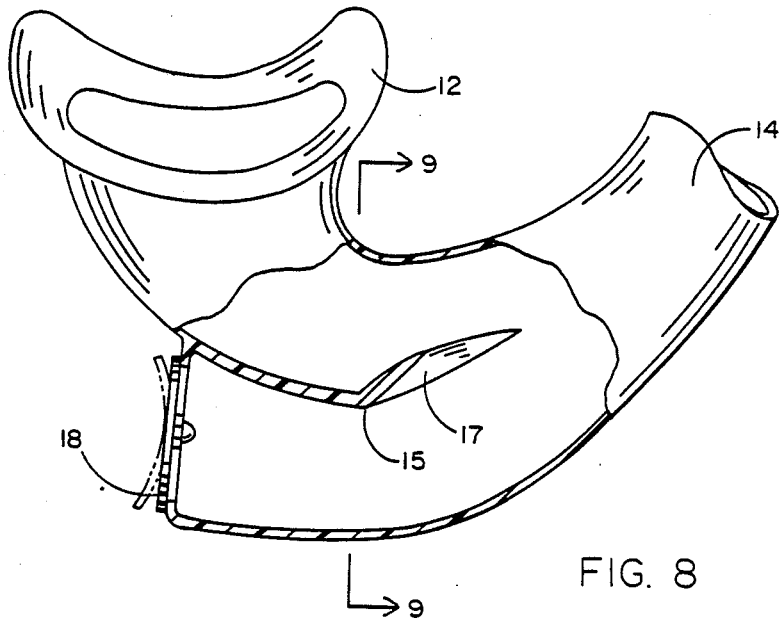
FIG. 8 is a partially cross-sectioned view of an alternate embodiment illustrating the use of a biased deflector orientation.
Figure 9:
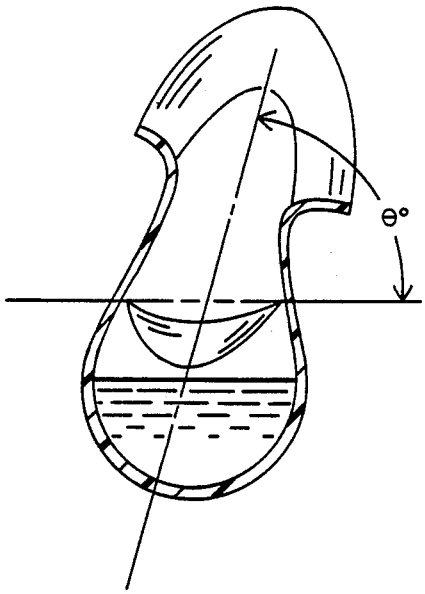
FIG. 9 is a cross-sectional view taken along lines 9—9 of FIG. 8.
Figure 11:
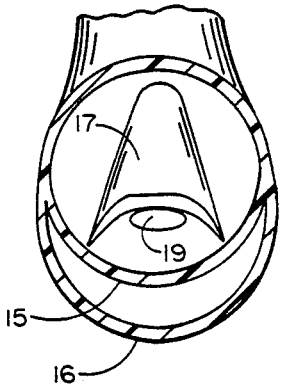
FIG. 11 is a cross-sectional view taken along lines 1—1 of FIG. 4.

A second novel and advantageous feature of the present invention resides in a rise or deflector 17 which is positioned on the mouthpiece side of partition 15 as shown in FIG. 1 and in FIGS. 4–9 as well as in FIG. 11. FIG. 4 illustrates a substantially identical snorkel configuration to that shown in FIG. 1. However, in the embodiment of FIG. 4, the trough 20 has been replaced by a conventional aperture 19 in the partition 15. In either instance, the operation of the rise or deflector 17 tends to resist the flow of water along the mouthpiece side surface of partition 15 to reduce the likelihood of such water from reaching the mouthpiece. In addition, the rise or deflector 17 tends to channel any such water on the mouthpiece side of partition 15 into either aperture 22 of trough 20 in the embodiment of FIG. 1 or aperture 19 in the embodiment of FIG. 4. FIGS. 5–9 illustrate alternate deflector configurations. In FIG. 5 the deflector 17 straddles a stepped partition 15 having a passage 19. FIGS. 6 and 7 illustrate the cross-sectional view 6—6 of FIG. 5 in two snorkel orientations. In FIGS. 8 and 9, partition 15 uses a rise or deflector 17 which is orientated at non-perpendicular angle to reduce flow toward the mouthpiece 12 at usual snorkel "head-down" configurations.

Figure 10:
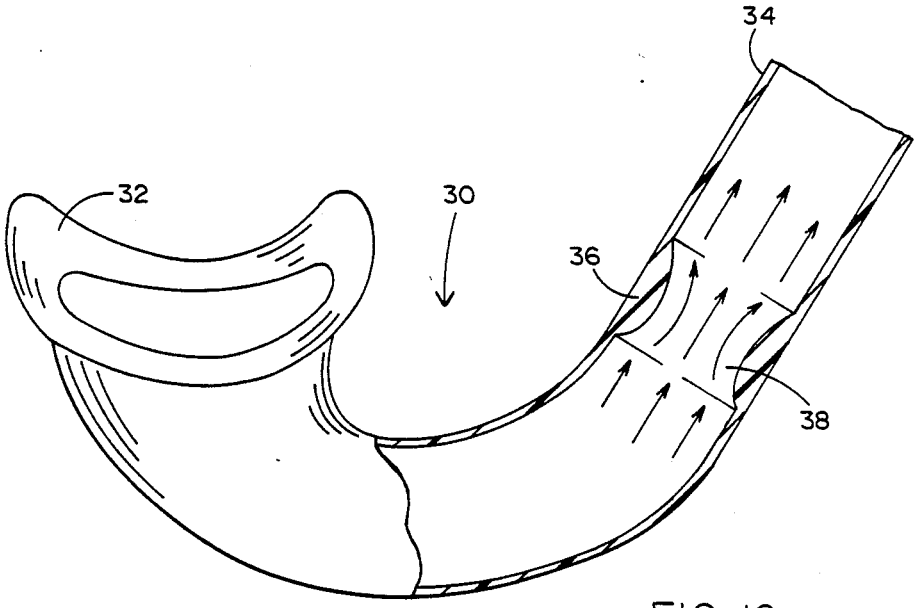
FIG. 10 is a partially crossed-section isometric view of a third embodiment of the present invention showing the Venturi constriction feature.

An additional embodiment of the present invention is illustrated in FIG. 10. This embodiment 30 comprises a mouthpiece 32 and a breathing tube 34 wherein either the mouthpiece or the breathing tube provides a thickened wall portion 36 forming a constriction 38. It will be understood that constriction 38 may also be formed in the mouthpiece after it has been extended and also without thickening the wall of breathing tube 34, but instead by providing an annular depression in the wall of breathing tube 34 using a constant thickness wall structure. In either case, the constriction 38 provides a Venturi-like effect which accelerates airflow generated upon exhalation by the diver which promotes laminar flow of the water being expelled through the tube and does so without any substantial restriction of air to the driver. On the contrary, the venturi restriction will increase the breathing performance of the snorkel. Such laminar flow effectively holds the water molecules together resulting in the effect of shooting a plug of water upon exhalation and thereby providing a more efficient system of expelling of water from the breathing tube which to the diver reduces the effort and the amount of residual remaining water in the tube. Without the Venturi constriction 38, there is a greater likelihood that the air and water will mix together thereby effectively increasing the volume of the water being expelled. This water volume increase also increases the volume of air required to expell the water thereby increasing the probability of residual water drops flowing back through the tube toward the mouthpiece. The Venturi restriction promotes alignment of the water molecules through the constricted passage and forces the expelled breath to be positioned behind the water molecules. It also increases the speed of both air and water out of the snorkel upon being expelled. This increase of air into the snorkel is of benefit to the diver in increased breathing performance.

Figure 12:
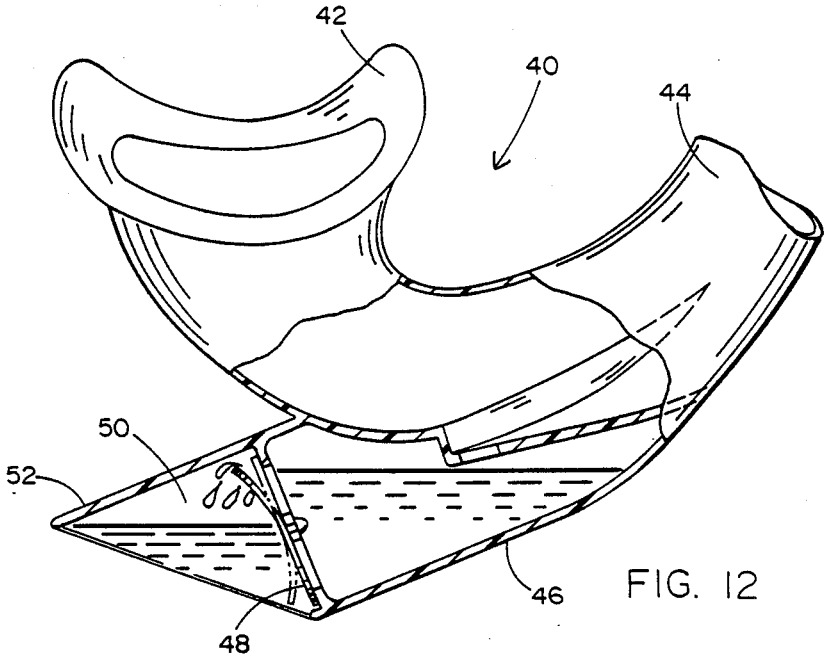
FIG. 12 is a partially crossed-section isometric view of a fourth embodiment of the invention showing the air trap feature thereof.

Still an additional embodiment of the invention is shown in FIG. 12. More specifically, embodiment 40 of the present invention provides a mouthpiece 42, a breathing tube 44 and a branch conduit 46 terminating in a check valve 48. The improved feature of the present invention comprises an air trap 50 formed by utilizing a hood or sheath 52 which forms an air bubble trap behind the diaphram or check valve 48 on the ambient water side of the exhaust valve. This feature promotes the formation of an air bubble from the expelled divers breath which is trapped in this hood or sheath. The air trap then allows the valve to open easier than a valve which opens against the higher viscosity of the ambient water and results in easier water drainage from the reservoir in the branch conduit 46.

It should be understood that while the various features of the present invention are shown in the accompanying drawings as being independent of one another, the present also contemplates having a single snorkel which incorporates any combination including all of the aforementioned features to achieve a substantial improvement in the efficiency of expelling water from the snorkel and in the reduction of the possible interference of any remaining water with breathing through the snorkel. The features described herein comprise a specially shaped trough in the partition between the main conduit of the breathing tube and the branch conduit, the latter being provided with a purge valve that is described in U.S. Pat. No. 4,278,080. The trough is designed to provide an aperture at its lower most portion and has a convex shaped wall for promoting the drainage of water into the branch conduit and preventing the return of the water into the mouthpiece side of the breathing tube. Another feature of the present invention comprises a rise or deflector on the mouthpiece side of the partition between the main conduit and the branch conduit. The rise or deflector, tends to resist or prevent the flow of water towards the mouthpiece and instead channels the water through the aperture in the partition to drain into the branch conduit. Still another feature of the present invention comprises a constriction in the breathing tube of the snorkel to produce a Venturi effect during exhalation to increase the efficiency of water expelling and increase the breathing performance during inhalation. Still another feature of the present invention comprises the use of an air trap on the ambient water side of the purge valve to make it easier for water to drain through the purge valve than would otherwise be the case if the water were draining through the purge valve against the higher viscosity of the ambient water.

Those having skill in the art to which the present invention pertains, will now, as a result of the applicant's teaching herein, perceive various modifications and additions which may be made to the invention. By way of example, other shapes and sizes of the various features such as the trough shape in the partition, the rise or deflector, the constriction and the air trap will now become evident. However, it will be understood that all such modifications and/or additions are deemed to be within the scope of the invention which is to limited only by the claims apended hereto.

I claim:

1. An improved snorkel of the type having a main conduit and a bypass conduit separated from the main conduit by a partition, the main conduit terminating in a mouthpiece at one end and terminating in a breathing tube at the other end, the bypass conduit terminating in a purge valve for permitting a diver to purge water from the snorkel with reduced exhalation effort; the improvement comprising:

a trough-shaped depression in said partition, said depression having a wall extending toward said bypass conduit and having an aperture for promoting draining of water from said main conduit into said bypass conduit;

said partition and bypass conduit being positioned to be below said mouthpiece when said breathing tube is substantially vertical whereby said aperture is also below said mouthpiece.

2. The improvement recited in claim 2 further comprising an aperture through said partition adjacent said deflector, said deflector being shaped to channel water through said aperture into said bypass conduit;

said partition and bypass conduit being positioned to be below said mouthpiece when said breathing tube is substantially vertical whereby said aperture is also below said mouthpiece.

3. An improved snorkel of the type having a main conduit and a bypass conduit separated from the main conduit by a partition, the main conduit terminating in a mouthpiece at one end and terminating in a breathing tube at the other end, the bypass conduit terminating in a purge valve for permitting a diver to purge water from the interior of the snorkel to the exterior of the snorkel with reduced exhalation effort; the improvement comprising:

a hood attached to said bypass conduit on the exterior of said purge valve and forming an air trap on the exterior of said valve between said valve and said hood for promoting water drainage through said valve.

4. An improved snorkel of the type having a main conduit and a bypass conduit separated from the main conduit by a partition, the main conduit terminating in a mouthpiece at one end and terminating in a breathing tube at the other end, the bypass conduit terminating in a purge valve for permitting the self-draining of residual water in the breathing tube and allowing a diver to purge water from the interior of the snorkel to the exterior of the snorkel with reduced exhalation effort; the improvement comprising:

a trough-shaped depression in said partition, said depression having a wall extending toward said bypass conduit and having an aperture for promoting drainage of water from said main conduit into said bypass conduit; and a deflector positioned on the main conduit side of said partition and shaped to resist the flow of water toward said mouthpiece;

said partition and bypass conduit being positioned to be below said mouthpiece when said breathing tube is substantially vertical whereby said aperture is also below said mouthpiece.

5. The improvement recited in claim 4 further comprising:

a hood attached to said bypass conduit on the exterior of said purge valve and forming an air trap on the exterior of said valve between said valve and said hood for promoting water drainage through said valve.

6. An improved snorkel of the type having a snorkel conduit and a bypass conduit separated from the main conduit by a partition, the main conduit terminating in a mouthpiece at one end and terminating in a breathing tube at the other end, the bypass conduit terminating in a purge valve for permitting the self-draining of residual water in the breathing tube and allowing a diver to purge water from the interior of the snorkel to the exterior of the snorkel with reduced exhalation effort; the improvement comprising:

a deflector positioned on the main conduit side of said partition and shaped to resist the flow of water toward said mouthpiece;

a hood attached to said bypass conduit on the exterior of said purge valve and forming an air trap on the exterior of said valve between said valve and said hood for promoting water drainage through said valve.

7. The improvement recited in claim 6 further comprising an aperture through said partition adjacent said deflector, said deflector being shaped to channel water through said aperture into said bypass conduit;

said partition and bypass conduit being positioned to be below said mouthpiece when said breathing tube is substantially vertical whereby said aperture is also below said mouthpiece.

* * * * *